US011174564B2

(12) United States Patent
Jonnalagadda et al.

(10) Patent No.: US 11,174,564 B2
(45) Date of Patent: Nov. 16, 2021

(54) ELECTROFORMING SYSTEM AND METHOD

(71) Applicant: Unison Industries, LLC, Jacksonville, FL (US)

(72) Inventors: Dattu GV Jonnalagadda, Ponnur (IN); Karthick Vilapakkam Gourishankar, Karnataka (IN); Merin Sebastian, Karnataka (IN); Sandeep Kumar, Karnataka (IN); Gordon Tajiri, Waynesville, OH (US)

(73) Assignee: Unison Industries, LLC, Jacksonville, FL (US)

( * ) Notice: Subject to any disclaimer, the term of this patent is extended or adjusted under 35 U.S.C. 154(b) by 196 days.

(21) Appl. No.: 16/176,203

(22) Filed: Oct. 31, 2018

(65) Prior Publication Data

US 2020/0131653 A1 Apr. 30, 2020

(51) Int. Cl.

| | |
|---|---|
| ***C25D 17/02*** | (2006.01) |
| ***C25D 17/12*** | (2006.01) |
| ***C25D 1/00*** | (2006.01) |
| ***C25D 17/00*** | (2006.01) |

(52) U.S. Cl.

CPC ..... *C25D 1/00* (2013.01); *C25D 17/00* (2013.01); *C25D 17/12* (2013.01)

(58) Field of Classification Search

None

See application file for complete search history.

(56) References Cited

U.S. PATENT DOCUMENTS

| | | | |
|---|---|---|---|
| 1,845,052 | A | 2/1932 | Laukel |
| 3,498,890 | A | 3/1970 | Divecha et al. |
| 3,617,449 | A | 11/1971 | Cottenham et al. |
| 3,929,592 | A | 12/1975 | Klingenmaier |
| 4,304,641 | A | 12/1981 | Grandia et al. |
| 4,359,375 | A | 11/1982 | Smith |
| 4,434,039 | A | 2/1984 | Baboian et al. |
| 4,441,976 | A | 4/1984 | Iemmi et al. |
| 4,529,486 | A | 7/1985 | Polan |
| 4,534,831 | A | 8/1985 | Inoue |
| 4,853,099 | A | 8/1989 | Smith |
| 4,933,061 | A | 6/1990 | Kulkarni et al. |
| 5,421,987 | A | 6/1995 | Tzanavaras et al. |

(Continued)

FOREIGN PATENT DOCUMENTS

| | | | |
|---|---|---|---|
| CN | 1489714 | A | 4/2004 |
| CN | 101363127 | A | 2/2009 |

(Continued)

OTHER PUBLICATIONS

European Patent Office, Extended European Search Report re Corresponding Application No. 19206054.9-1103, dated Mar. 31, 2020, 7 pages, Munich, Germany.

(Continued)

*Primary Examiner* — Stefanie S Wittenberg

(74) *Attorney, Agent, or Firm* — McGarry Bair PC

(57) ABSTRACT

An electroforming system and method for electroforming a component includes an electroforming reservoir with a housing with at least one inlet and at least one outlet, and at least one anode chamber within the housing and fluidly coupled to the at least one inlet. An anode can be located within the at least one anode chamber.

22 Claims, 6 Drawing Sheets

(56) References Cited

U.S. PATENT DOCUMENTS

| | | | |
|---|---|---|---|
| 5,516,412 | A | 5/1996 | Andricacos et al. |
| 5,562,810 | A | 10/1996 | Urquhart |
| 5,597,460 | A | 1/1997 | Reynolds |
| 5,837,120 | A | 11/1998 | Forand et al. |
| 5,932,077 | A | 8/1999 | Reynolds |
| 5,958,604 | A | 9/1999 | Riabkov et al. |
| 5,976,340 | A | 11/1999 | Sheldon et al. |
| 6,004,447 | A | 12/1999 | Bischoping et al. |
| 6,099,702 | A | 8/2000 | Reid et al. |
| 6,126,798 | A | 10/2000 | Reid et al. |
| 6,136,163 | A | 10/2000 | Cheung et al. |
| 6,348,138 | B1 | 2/2002 | Yoshimura et al. |
| 6,379,511 | B1 | 4/2002 | Fatula et al. |
| 6,551,472 | B2 | 4/2003 | Saito et al. |
| 6,761,807 | B2 | 7/2004 | Velez, Jr. et al. |
| 6,821,407 | B1 | 11/2004 | Reid et al. |
| 7,083,332 | B2 | 8/2006 | Mukouda |
| 7,837,843 | B2 | 11/2010 | Sharp et al. |
| 7,892,411 | B2 | 2/2011 | Tachibana et al. |
| 8,262,871 | B1 | 9/2012 | Mayer et al. |
| 8,980,067 | B2 | 3/2015 | Secherling et al. |
| 9,249,521 | B2 | 2/2016 | Tomastschger et al. |
| 9,816,194 | B2 | 11/2017 | He et al. |
| 9,970,120 | B2 | 5/2018 | Tomantschger et al. |
| 9,988,735 | B2 | 6/2018 | Papapanayiotou et al. |
| 2004/0016637 | A1 | 1/2004 | Yang et al. |
| 2004/0134775 | A1 | 7/2004 | Yang et al. |
| 2004/0226826 | A1 | 11/2004 | Cheng et al. |
| 2005/0109612 | A1 | 5/2005 | Woodruff et al. |
| 2006/0131177 | A1 | 6/2006 | Bogart et al. |
| 2009/0078579 | A1 | 3/2009 | Weibezahn |
| 2009/0272644 | A1* | 11/2009 | Lukkarila ..... C25D 17/008 204/263 |
| 2010/0032303 | A1 | 2/2010 | Reid et al. |
| 2010/0147679 | A1 | 6/2010 | Feng et al. |
| 2010/0170801 | A1 | 7/2010 | Metzger |
| 2015/0129418 | A1* | 5/2015 | Keigler ..... C25D 21/10 204/237 |
| 2018/0016688 | A1 | 1/2018 | Angelini |

FOREIGN PATENT DOCUMENTS

| | | | | |
|---|---|---|---|---|
| CN | 104024490 | * | 9/2014 | ..... C25D 21/00 |
| CN | 105378154 | A | 3/2016 | |
| CN | 105755510 | A | 7/2016 | |
| DE | 19539865 | * | 4/1999 | ..... C25D 17/00 |
| GB | 2103248 | A | 2/1983 | |
| JP | 2003043306 | | 2/2003 | |
| WO | 9836107 | A1 | 8/1998 | |

OTHER PUBLICATIONS

CN105755510A, Bibliographic Data.
CN10537815A, U.S. Pat. No. 9,988,735B2.
CN1489714A, U.S. Pat. No. 7,083,332B2.
CN101363127A, U.S. Pat. No. 7,892,411B2.

* cited by examiner

ELECTROFORMING SYSTEM AND METHOD

BACKGROUND

An electroforming process can create, generate, or otherwise form a metallic layer of a desired component. In one example of the electroforming process, a mold or base for the desired component can be submerged in an electrolytic liquid and electrically charged. The electric charge of the mold or base can attract an oppositely-charged electroforming material through the electrolytic solution. The attraction of the electroforming material to the mold or base ultimately deposits the electroforming material on the exposed surfaces mold or base, creating an external metallic layer.

BRIEF DESCRIPTION

In one aspect, the disclosure relates to an electroforming reservoir. The electroforming reservoir includes a housing with at least one inlet and at least one outlet, at least one anode chamber within the housing and fluidly coupled to the at least one inlet, an anode within the at least one anode chamber, and an electroforming chamber within the housing and fluidly coupled to the at least one anode chamber and the at least one outlet.

In another aspect, the disclosure relates to a system for electroforming a component. The system includes a fluid reservoir containing an electrolytic fluid, a first anode, and a first cathode, a first power source electrically coupled to the first anode and first cathode, and at least one electroforming reservoir. The electroforming reservoir can include a housing with at least one inlet and at least one outlet, at least one anode chamber within the housing and fluidly coupled to the fluid reservoir via the at least one inlet, a sacrificial second anode within the at least one anode chamber, and an electroforming chamber within the housing and fluidly coupled to the anode chamber and the at least one outlet.

In another aspect, the disclosure relates to a method of electroforming a component. The method includes introducing an electrolyte solution to at least one anode chamber within an electroforming reservoir, generating additional electrolytes in the electrolyte solution by supplying electrical power to an anode within the at least one anode chamber to define an enriched electrolyte solution, providing the enriched electrolyte solution into an electroforming chamber holding a workpiece, and depositing, via the enriched electrolyte solution, a metal layer onto the workpiece to define an electroformed component.

DETAILED DESCRIPTION

Figure 1:
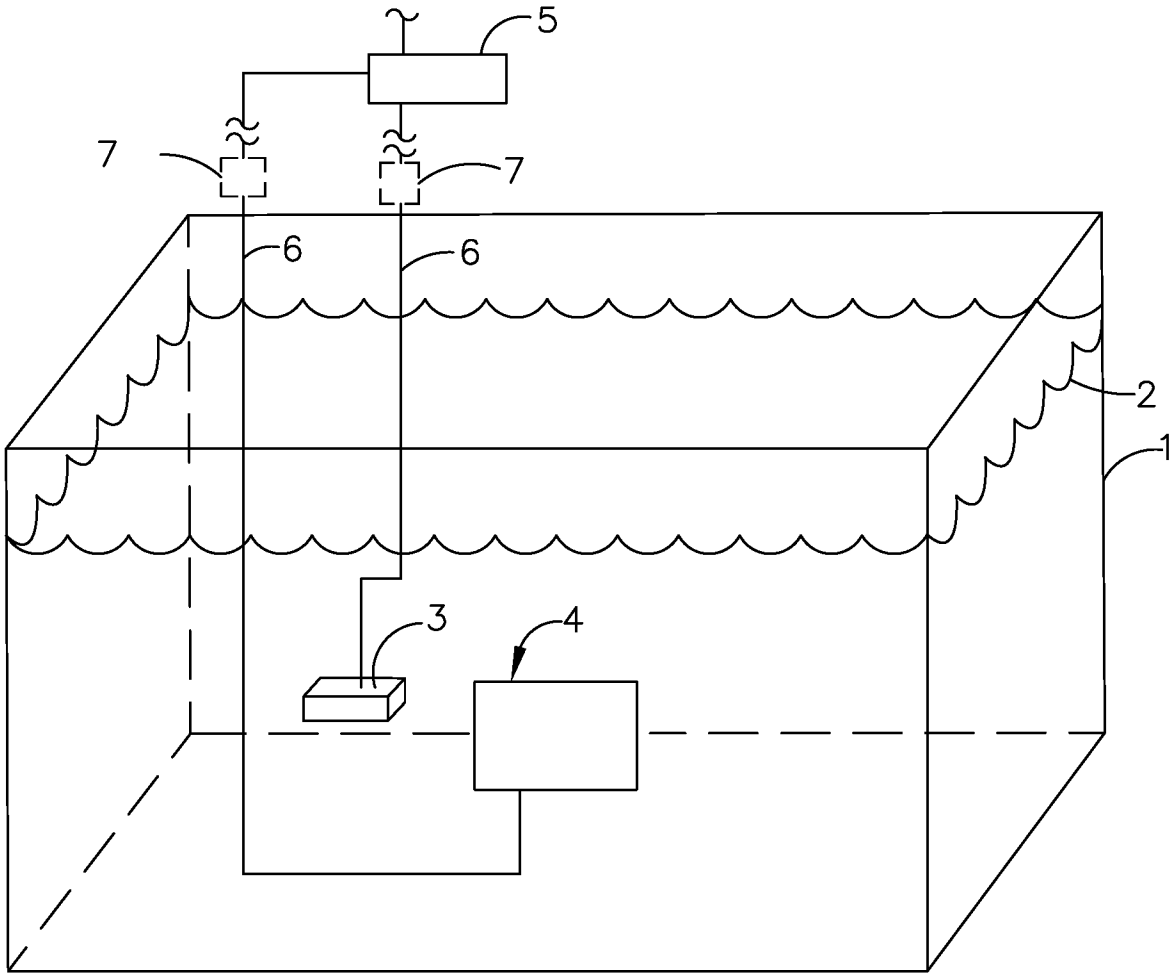
FIG. 1 (PRIOR ART)
FIG. 1 is a schematic view of a prior art electroforming bath for forming a component.

Aspects of the present disclosure are directed to a system and method for electroforming a component. It will be understood that the disclosure can have general applicability in a variety of applications, including that the electroformed component can be utilized in any suitable mobile and non-mobile industrial, commercial, and residential applications.

As used herein, an element described as "conformable" will refer to that element having the ability to be positioned or formed with varying geometric profiles that match or otherwise are similar or conform to another piece. This can include that the element can be conformable strips or moldable elements. In addition, as used herein, "non-sacrificial anode" will refer to an inert or insoluble anode that does not dissolve in electrolytic fluid when supplied with current from a power source, while "sacrificial anode" will refer to an active or soluble anode that can dissolve in electrolytic fluid when supplied with current from a power source. Non-limiting examples of non-sacrificial anode materials can include titanium, gold, platinum, silver, and rhodium. Non-limiting examples of sacrificial anode materials can include nickel, cobalt, tungsten, molybdenum, copper, zinc, lead, and magnesium. It will be understood that various alloys of the metals listed above may be utilized as sacrificial or non-sacrificial anodes.

All directional references (e.g., radial, axial, proximal, distal, upper, lower, upward, downward, left, right, lateral, front, back, top, bottom, above, below, vertical, horizontal, clockwise, counterclockwise, upstream, downstream, aft, etc.) are only used for identification purposes to aid the reader's understanding of the present disclosure, and do not create limitations, particularly as to the position, orientation, or use of the disclosure. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. In addition, as used herein "a set" can include any number of the respectively described elements, including only one element.

The exemplary drawings are for purposes of illustration only and the dimensions, positions, order, and relative sizes reflected in the drawings attached hereto can vary.

A prior art electroforming process is illustrated by way of an electrodeposition bath in FIG. 1. As used herein, "electroforming" or "electrodeposition" can include any process for building, forming, growing, or otherwise creating a metal layer over another substrate or base. Non-limiting examples of electrodeposition can include electroforming, electroless forming, electroplating, or a combination thereof. While the remainder of the disclosure is directed to electroforming, any and all electrodeposition processes are equally applicable.

A prior art bath tank 1 carries a single metal constituent solution 2 having alloying metal ions. A soluble anode 3 spaced from a cathode 4 is provided in the bath tank 1. A component to be electroformed can form the cathode 4.

A controller 5, which can include a power source or supply, can electrically couple to the soluble anode 3 and the cathode 4 by electrical conduits 6 to form a circuit via the conductive metal constituent solution 2. Optionally, a switch 7 or sub-controller can be included along the electrical conduits 6 between the controller 5, soluble anode 3, and cathode 4. During operation, a current can be supplied from the soluble anode 3 to the cathode 4 to electroform a body at the cathode 4. Supply of the current can cause metal ions from the single metal constituent solution 2 to form a metallic layer over the cathode 4.

In a conventional electroplating process, the soluble anode 3 changes the shape as it dissolves, resulting in variations in the electric field between the soluble anode 3 and the cathode 4. Variations in the shape of the soluble anode 3 result in variations in the thickness of the deposited layer resulting to non-uniform thickness. Also, when the soluble anodes dissolves, particulates are released to the electrolyte. These particulates matter contaminate the cathodic surface for electrodeposition, resulting in non-uniform deposition. While not specifically illustrated, the prior art bath tank 1 can include the conventional technique of reducing particulate contamination from the anode 3 by containing the anode 3 in a porous anode bag. Even though the anode bag prevents large size contaminants being released into the plating solution, it fails to prevent smaller sized particulates from entering the plating solution and contaminating the cathodic plating surface. This results in a non-uniform deposition. Aspects of the present disclosure relate to a sacrificial anode system where the anode dissolution and the electroforming occurs in separate tanks. The chance of particulates being liberated at the anode dissolution tank reaching the cathode located at the electroforming tank is minimized.

Figure 2:
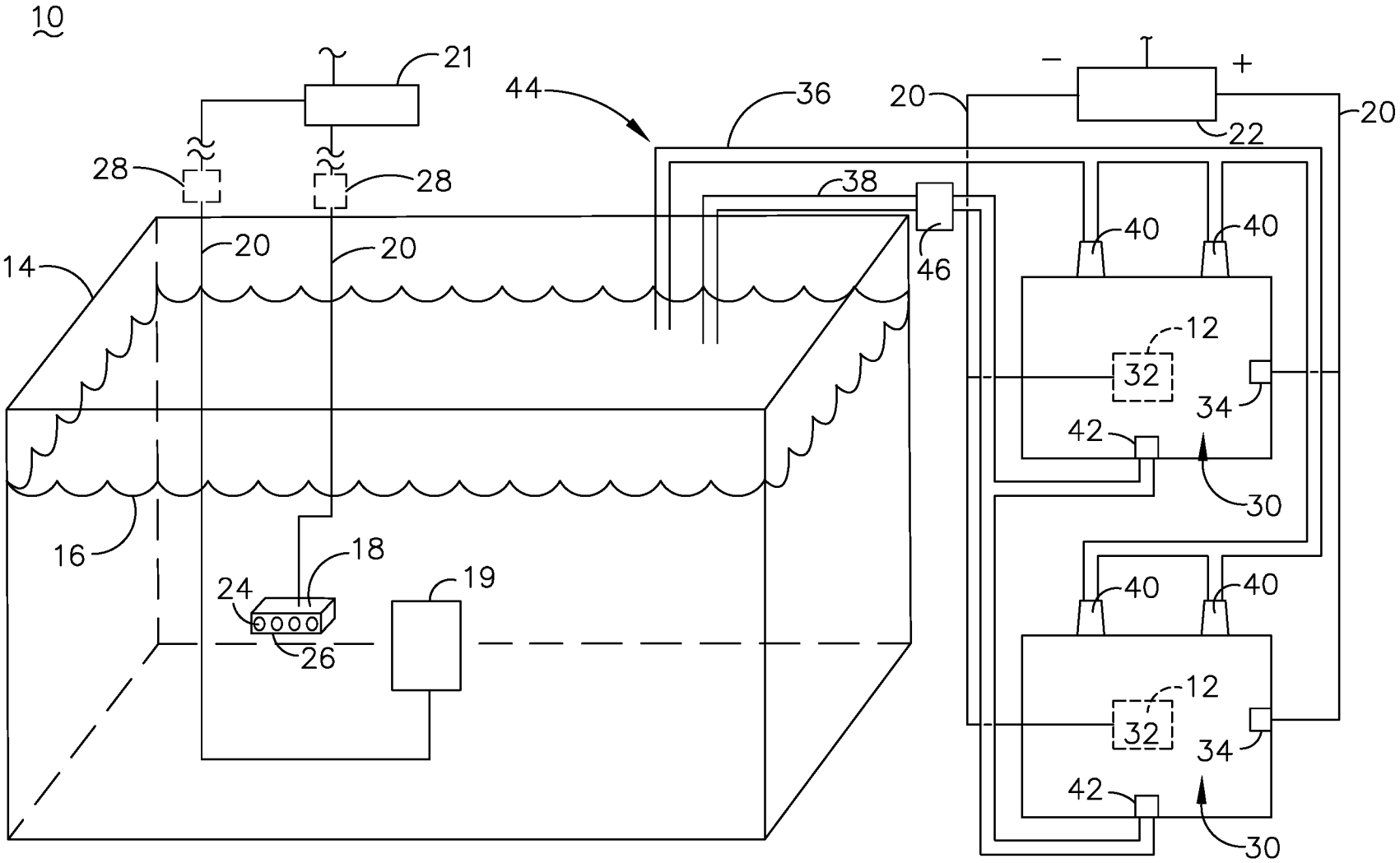
FIG. 2 is a schematic view of a system for electroforming a component according to various aspects of the disclosure.

FIG. 2 illustrates a system 10 for electroforming a component 12. The system 10 includes a fluid reservoir 14 containing an electrolyte solution or electrolytic fluid 16. In a non-limiting example the electrolytic fluid 16 can include nickel sulphamate, however, any suitable electrolytic fluid 16 can be utilized. A first anode 18 is located within the fluid reservoir 14. It is contemplated, by way of non-limiting example, that the first anode 18 can be sacrificial and include nickel and cobalt portions in the form of coins 24 placed within a titanium basket 26 surrounded by a mesh material. The mesh material can provide for containment of the nickel and cobalt coins 24 as well as any particulate material that may be present within the first anode 18 while allowing the flow of electrolytic fluid 16 through or around the first anode 18.

The first anode 18 can be submerged in the electrolytic fluid 16 and electrically coupled via electrical conduits 20 to a first power source 21. The first power source 21 can also include a controller module to control the flow of current through the electrical conduits 20; alternately, a separate controller may be provided and electrically coupled to the first power source 21.

A first cathode 19 can also be located within the fluid reservoir 14 spaced from the first anode 18 and electrically coupled to the first power source 21. The first cathode 19 can include any suitable conductive material. In one example the first cathode 19 can include an inert material such as titanium, gold, or rhodium.

Switches 28 can optionally be provided between the first power source 21 and the first anode 18 or first cathode 19 to selectively provide power to the first anode 18 or first cathode 19.

At least one electroforming reservoir 30 is also include in the system 10. While two electroforming reservoirs 30 are illustrated, any number of electroforming reservoirs 30 can be utilized in the system 10. In addition, the electroforming reservoirs 30 can be formed to have a variety of sizes or shapes. In a non-limiting example, one electroforming reservoir can contain a workpiece with a duct section spanning 80 cm while another electroforming reservoir can contain a workpiece with a bracket spanning 14 cm.

Each of the multiple electroforming reservoirs 30 can also be fluidly coupled to the fluid reservoir 14 by way of an inlet conduit 36 and a drain conduit 38. The electroforming reservoir 30 can be metallic or polymeric and can be formed by any suitable process, including machining or injection molding. The electroforming reservoir 30 can include at least one inlet 40 fluidly coupled to the inlet conduit 36 and at least one outlet 42 fluidly coupled to the drain conduit 38. A recirculation circuit 44 can be defined between the fluid reservoir 14 and the electroforming reservoir 30, wherein electrolytic fluid 16 can flow from the fluid reservoir 14 through the inlet conduit 36, flow through at least one electroforming reservoir 30, and flow through the drain conduit 38 back into the fluid reservoir 14. Optionally, a pump 46 can be fluidly coupled to the recirculation circuit 44 and is schematically illustrated as being positioned along the drain conduit 38. The pump 46 can be utilized at any suitable position in the recirculation circuit 44 including along the inlet conduit 36; alternately, multiple pumps 46 can be utilized. It is also contemplated that the electrolytic fluid 16 can be gravity fed into the electroforming reservoir 30 without use of a pump. In this manner, electrolytic fluid 16 can be supplied from the fluid reservoir 14 to any or all of the electroforming reservoirs 30. The electrolytic fluid 16 can be continuously supplied from the fluid reservoir 14; alternately, the electrolytic fluid 16 can be supplied in discrete portions at regular or irregular time intervals as desired. For example, the pump 46 can be instructed to supply a predetermined volume of electrolytic fluid (e.g. 2.0 liters) to the electroforming reservoir 30 at predetermined time intervals (e.g. every 35 minutes).

A sacrificial second anode 34 and a second cathode 32, forming an electroformed component 12, can be included in each of the multiple electroforming reservoirs 30. As shown, the at least one electroforming reservoir 30 can be electrically coupled to a second power source 22 separate from the first power source 21.

Figure 3:
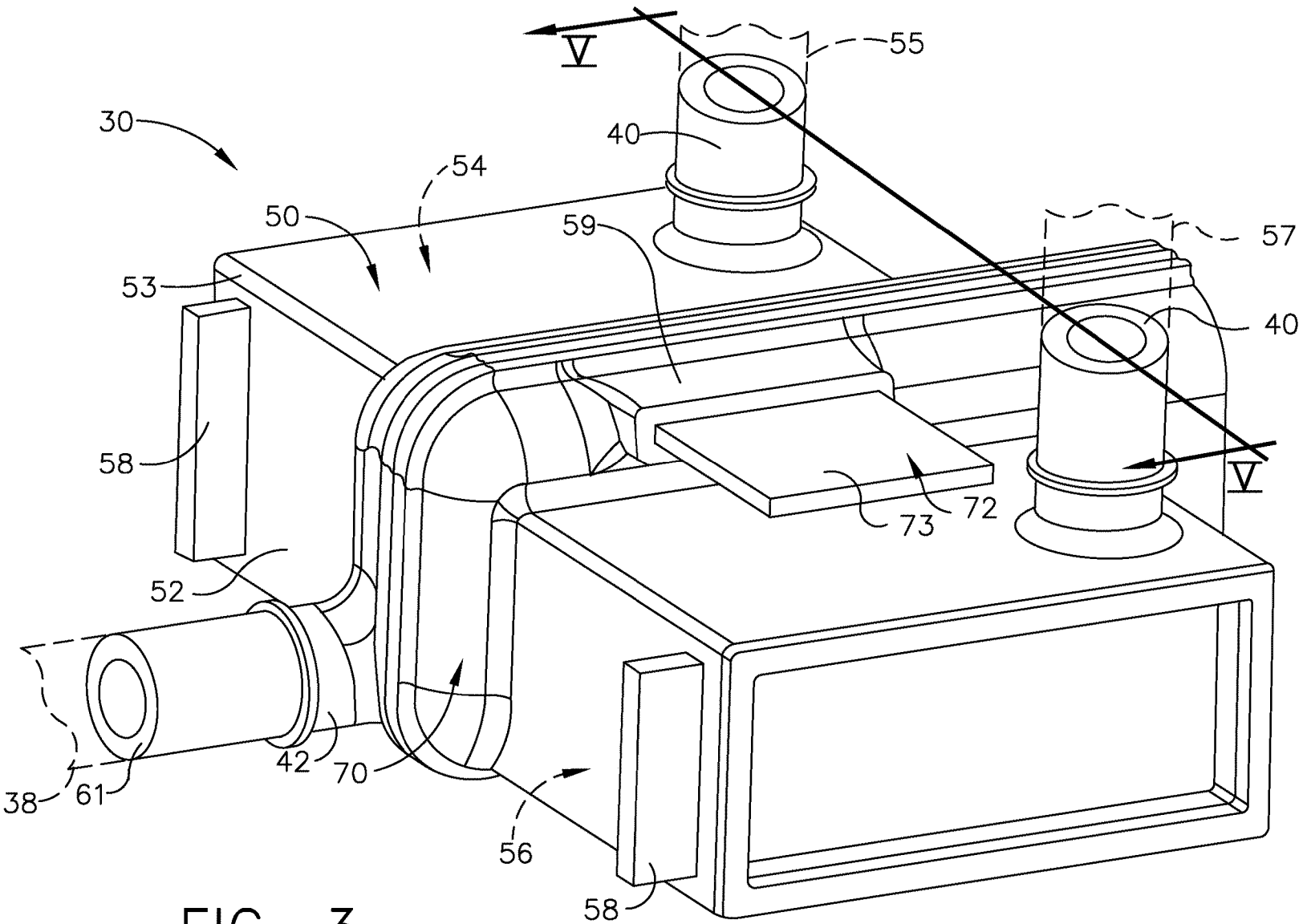
FIG. 3 is a perspective view of an electroforming reservoir that can be utilized in the system of FIG. 2.

FIG. 3 illustrates an exemplary electroforming reservoir 30 in further detail. More specifically, a housing 50 having at least one inlet 40 provided on an upper portion 53 of the housing 50 and at least one outlet 42 provided on a lower portion 52 of the housing 50 is illustrated as being included in the electroforming reservoir 30. The at least one outlet 42 can include a drain opening 61 fluidly coupled to the drain conduit 38 and extending into the electroforming reservoir 30. It is further contemplated that multiple drain openings 61 can be provided in the base 52 of the electroforming reservoir 30 as desired. It is further contemplated that the housing 50 can be any suitable material including metallic or polymeric, and can be formed in a variety of ways including machining or injection molding, in non-limiting examples. In one example, the entire housing 50 can be injection molded as a single piece including the at least one inlet 40 and the at least one outlet 42.

The housing 50 can include at least one anode chamber, illustrated as a first anode chamber 54 and a second anode chamber 56. Each anode chamber 54, 56 can include a removable or slidable cover 58 providing selective access to the interior of the corresponding anode chamber 54, 56.

Figure 4:
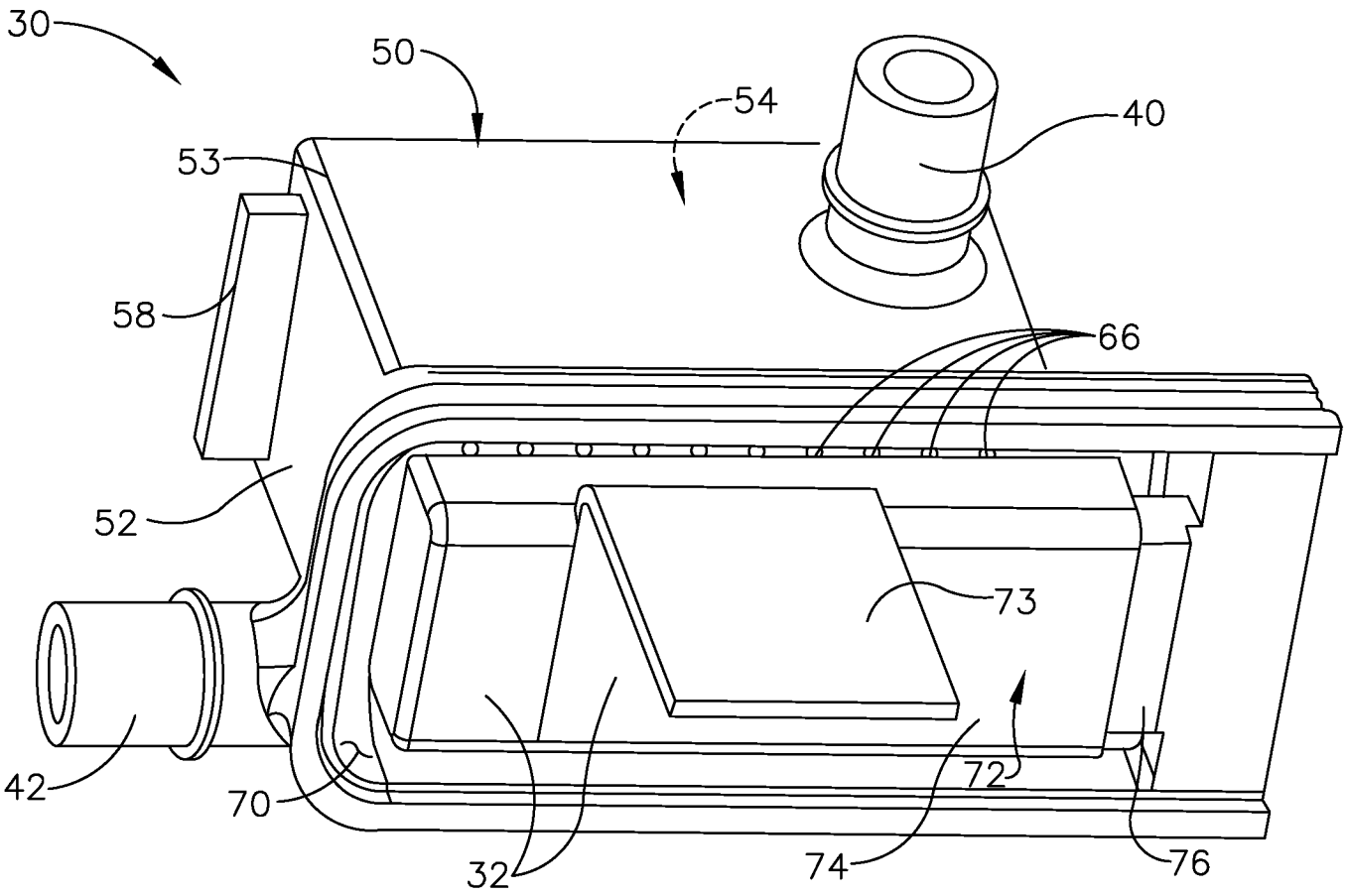
FIG. 4 is a perspective view of the electroforming reservoir of FIG. 3, with a portion removed and containing a workpiece.

As illustrated in FIG. 4, an electroforming chamber 70 can also be included within the housing 50. FIG. 4 illustrates a cutaway portion of the electroforming reservoir 30. The electroforming chamber 70 can be configured to accommodate an exemplary workpiece 72 which is shown as a bracket 73 coupled to a mandrel 74 (FIG. 4). Optionally, the electroforming reservoir 30 can include an opening 59 wherein a portion of the workpiece 72, such as a portion of the bracket 73, can extend outside of the electroforming chamber 70.

It is further contemplated that the electroforming chamber 70 can include a pedestal or mount 76 over which the mandrel 74 can be positioned such that electrolytic fluid or solution can surround as much of the workpiece 72 as possible during an electroforming process. The workpiece 72 can define the second cathode 32 electrically coupled to the second power source 22 (FIG. 2), such as by way of the electrical conduit 20. For example, the electrical conduit 22 can connect directly to the workpiece 72 such as through an opening (not shown) in the housing 50. Alternately, the electrical conduit 22 and workpiece 72 can be connected to a conductive portion (not shown) of the housing 50.

Figure 5:
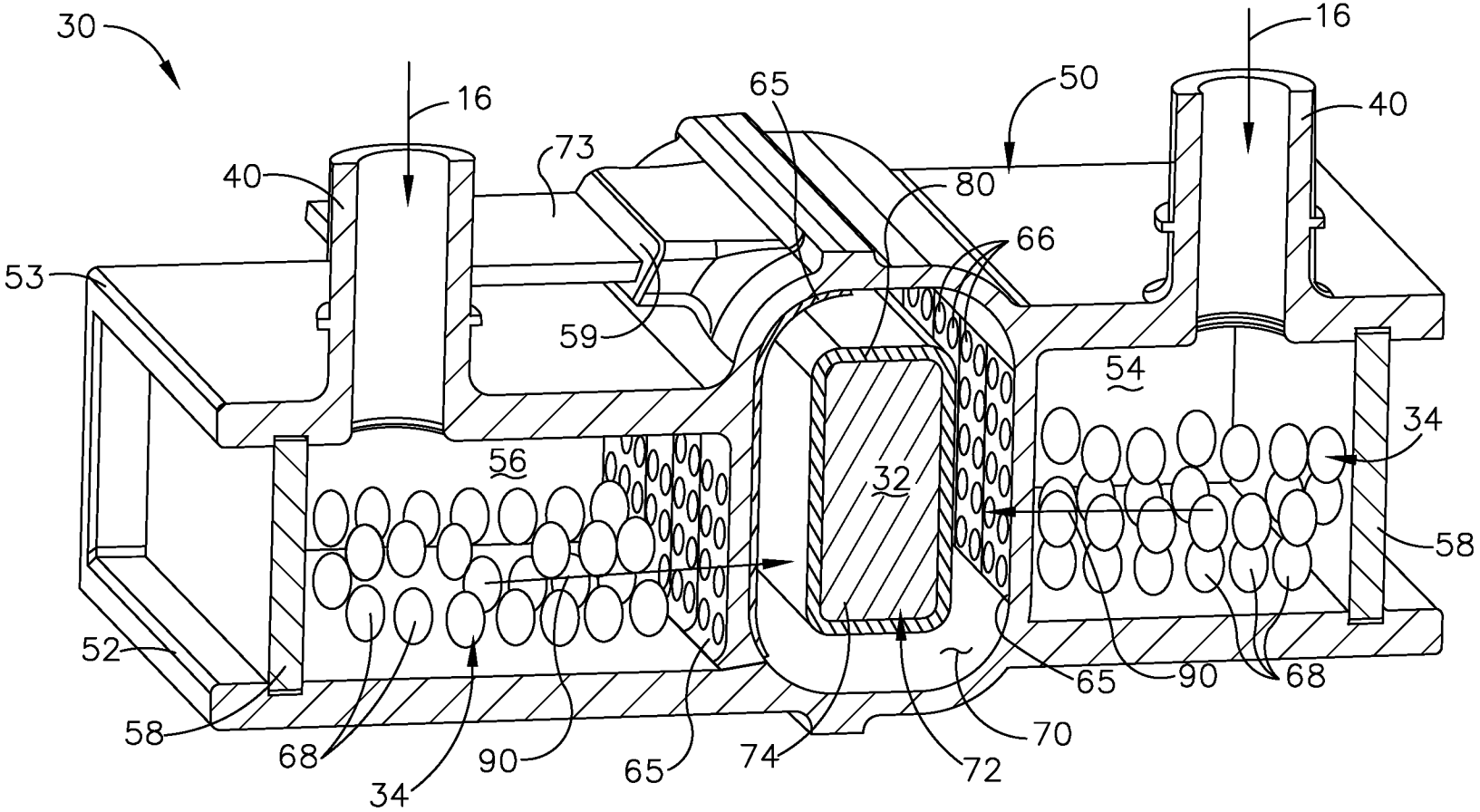
FIG. 5 is a sectional view of the electroforming reservoir of FIG. 3 along line V-V.

FIG. 5 illustrates a side sectional view of the electroforming reservoir 30. The electroforming chamber 70 can be positioned adjacent the at least one anode chamber, and in the illustrated example the electroforming chamber 70 is positioned between the first and second anode chambers 54, 56.

Arrows illustrate the flow of electrolytic fluid 16 through the inlets 40 into each of the first and second anode chambers 54, 56. In addition, the sacrificial second anode 34 is illustrated in the form of a plurality of coins 68 made of nickel or cobalt, or a combination thereof, which are positioned within each of the first and second anode chambers 54, 56. While not illustrated, the coins 68 can be electrically coupled to the second power source 22 (FIG. 2). In addition, while not shown, it is contemplated that a filter bag or other perforated container can surround the coins 68 within the first and second anode chambers 54, 56.

The sacrificial second anode 34, e.g. the coins 68 supplied with current from the second power source 22, can generate additional electrolytes in the solution to define an enriched electrolyte solution 90. As used herein, an "enriched" solution will refer to a concentration level of a component in solution. It should be understood that the enriched electrolyte solution 90 contains a higher concentration of electrolytes as compared to the electrolytic fluid 16 supplied by the fluid reservoir 14.

The electroforming chamber 70 can be fluidly coupled to the first and second anode chambers 54, 56 as well as to the least one outlet 42 (FIG. 4) and drain opening 61. At least one anode in the form of a non-sacrificial anode 65 can be located within the electroforming chamber 70. The at least one non-sacrificial anode 65 can include a plurality of apertures 66 such that electrolytic fluid can flow through and past the non-sacrificial anode 65 into the electroforming chamber 70. The non-sacrificial anodes 65 can be conformable, and can also include any suitable metallic material including titanium anode strips that can be formed to have the same shape or geometric profile as the workpiece 72.

A metal layer 80 is shown deposited onto the workpiece 72 to define the electroformed component 12. The metal layer 80 can have a layer thickness that can be tailored based on the apertures 66 directing the flow of electrolytic fluid 16 around the workpiece 72, as well as a spacing distance between the non-sacrificial anode 65 and the workpiece 72. In a non-limiting example the metal layer 80 can have a constant layer thickness; in another example, the metal layer 80 can have a variable thickness on different portions of the electroformed component 12. The bracket 73 is shown with one portion outside the electroforming reservoir 30 via the opening 59 (FIG. 3), and the remaining portion of the bracket 73 is within the electroforming chamber 70 and covered by the metal layer 80.

The non-sacrificial anode 65 is illustrated as a plurality of titanium strips having the apertures 66 and defining a boundary between the anode chambers 54, 56 and the electroforming chamber 70. Alternately, the non-sacrificial anode 65 can be positioned on a boundary wall that defines the boundary between the anode chambers 54, 56 and the electroforming chamber 70. It is contemplated that the non-sacrificial anode 65 can conform to a profile of at least a portion of the workpiece 72. As shown, the workpiece 72 has a flat profile and therefore the conformable non-sacrificial anodes 65 spaced from the workpiece 72 also have a flat profile. It can be appreciated that such conformable non-sacrificial anodes 65 can conform to any desired profile, including rounded corners or other features present on the workpiece 72 to control a thickness of the metal layer 80.

The non-sacrificial anodes 65 can have any desired spacing from the workpiece 72. In one example, each non-sacrificial anode 65 can have a uniform spacing distance from the workpiece 72 such as 10 mm. In another example, a first non-sacrificial anode 65 can be spaced from the workpiece 72 by a first amount such as 5 mm, and a second non-sacrificial anode 65 can be spaced from the workpiece 72 by a second distance such as 12 mm. In this manner, a local thickness of the metal layer 80 can be tailored or customized via at least one of the plurality of conformable non-sacrificial anodes 65 being not evenly spaced from the workpiece 72.

In operation, the first power source 21 supplies current from the first anode 18 to the first cathode 19 (FIG. 2) which causes metal ions to enter the electrolytic fluid 16. The electrolytic fluid 16 flows from the fluid reservoir 14 (FIG. 2) and can be pumped (e.g. via the pump 46) or gravity fed into the electroforming reservoir 30 and each of the first and second anode chambers 54, 56 via the inlets 40. It is contemplated that a variety of flow rates can be utilized; for example, electrolytic fluid 16 can flow into the first anode chamber 54 at a smaller first flow rate, such as 6 mL per second, while electrolytic fluid 16 can flow into the second anode chamber 56 at a larger second flow rate such as 10 mL per second. Alternately, electrolytic fluid 16 can flow into each of the first and second anode chambers 54, 56 at equal flow rates.

In addition, the first cathode 19 in the fluid reservoir 14 can be utilized to remove undesired metal ions from the electrolytic fluid 16. For example, under a predetermined supply of current from the first power source 21, undesired metal ions can plate out or deposit onto the first cathode 19 in a process commonly referred to as a "dummying" operation. The electrolytic fluid 16 supplied to the electroforming reservoirs 30 can thereby be cleaned of such undesired metal ions that may otherwise deposit onto the electroformed component 12. Such a dummying operation in the fluid reservoir 14 can be performed at predetermined time intervals or continuously, and can also be performed simultaneously with an electroforming process within the electroforming reservoirs 30. In such a case, the first power source 21 can generate a first power level suitable for the dummying operation, and the second power source 22 can generate a second power level suitable for electroforming within the electroforming chamber 70.

The cleaned, filtered electrolytic fluid 16 can flow into the first and second anode chambers 54, 56, where the sacrificial second anode 34 can provide additional ions to form the enriched electrolyte solution 90. The enriched electrolyte solution 90 can then flow through the apertures 66 toward the workpiece 72 in the electroforming chamber 70 and form the metal layer 80. For example, apertures 66 near the upper portion 53 can direct the enriched electrolyte solution 90 to flow perpendicularly to the top of the workpiece 72 and parallel to the sides of the workpiece 72. Apertures 66 near the center of the housing 50, or near the base 52, can direct the enriched electrolyte solution 90 to perpendicularly impinge the workpiece 72 before flowing downward toward the base 52. It can be appreciated that the apertures 66 can also be formed with varying shapes or centerline angles to further direct or tailor the flow of enriched electrolyte solution 90 around the workpiece 72. For example, the apertures 66 can be shaped to impinge enriched electrolyte solution 90 at a predetermined velocity upon the workpiece 72, e.g. decreasing a size of an aperture 66 causing an increase in electrolytic fluid velocity impinging upon the workpiece 72. Varying a centerline angle of an aperture 66 can cause the enriched electrolyte solution 90 to impinge the workpiece 72 at an angle between 0 and 90 degrees, which can provide for a customized thickness of the metal layer 80. The drain openings 61 can then direct spent or depleted electrolyte solution out of the electroforming chamber 70 and into the at least one outlet 42 and the drain conduit 38 (FIG. 2). The spent electrolyte solution can then recirculate back to the fluid reservoir 14 via the recirculation circuit 44 (FIG. 2). In addition, as the sacrificial second anode 34 is gradually consumed during successive electroforming processes, additional coins 68 can be provided to the anode chambers 54, 56 by way of the removable covers 58.

Figure 6:
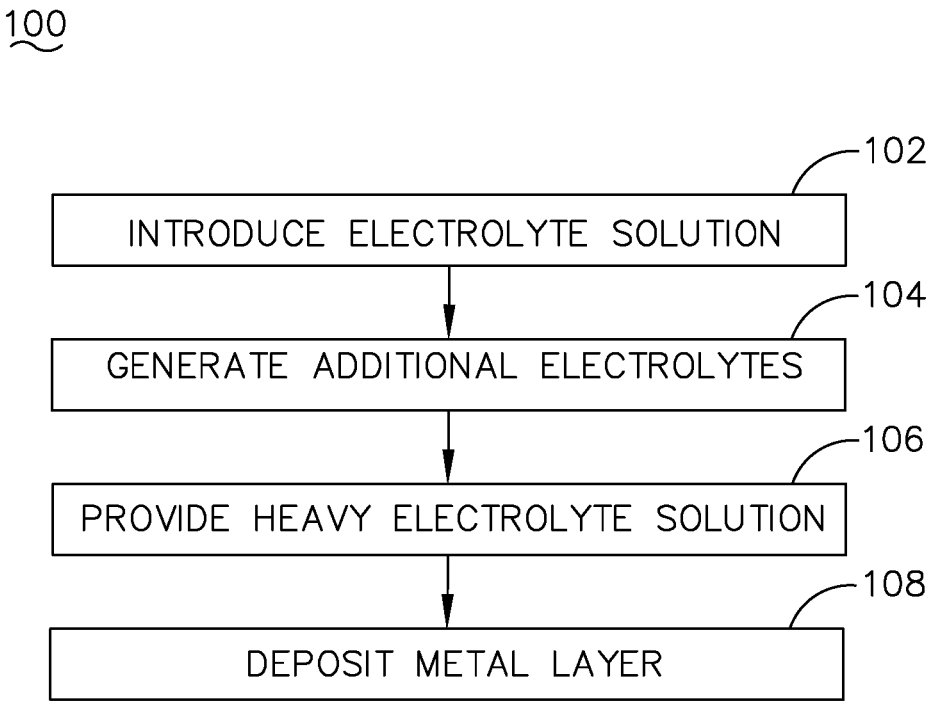
FIG. 6 is a flowchart diagram illustrating a method of electroforming a component according to various aspects of the disclosure.

FIG. 6 is a flowchart illustrating a method 100 of electroforming a component, such as the component 12. The method 100 includes at 102 introducing, via a supply conduit such as the first or second fluid conduits 55, 57, the electrolyte solution from the fluid reservoir 14 to at least one anode chamber 54, 56 within the electroforming reservoir 30. The electrolyte solution can be introduced via the first or second fluid conduits 55, 57 from the fluid reservoir 14 to at least one anode chamber 54, 56 as described above. In addition, the electrolyte solution can be pumped or gravity fed into the at least one anode chamber 54, 56 as described above.

At 104, the method includes generating, via the second power source 22, additional electrolytes in the electrolyte solution within either or both anode chambers 54, 56 by supplying electrical power to the sacrificial second anode 34 to define the enriched electrolyte solution 90. At 106, the method includes providing the enriched electrolyte solution 90 into the electroforming chamber 70 holding the workpiece 72, and at 110 the method includes depositing, via the enriched electrolyte solution 90, the metal layer 80 onto the workpiece 72 to define the electroformed component 12.

Optionally, the method 100 can include generating, via the first power source 21, electrolytes in a solution in an external fluid reservoir, such as the fluid reservoir 14, by supplying electrical power to the soluble first anode 18 to define an electrolytic solution such as the electrolytic fluid 16. The method 100 can also optionally include continuously introducing the electrolytic fluid 16, continuously generating additional electrolytes via the sacrificial second anode 34, or continuously providing the enriched electrolyte solution 90 to the electroforming chamber 70. Optionally, the method 100 can include providing a smaller flow rate of electrolytic fluid 16 to the first anode chamber 54 and a larger flow rate to the second anode chamber 56, or continuously varying a flow rate into each anode chamber 54, 56 as desired. Optionally, the method 100 can include pumping or gravity feeding spent or depleted electrolyte solution from the electroforming chamber 70 to the fluid reservoir 14 via the recirculation circuit 44.

Aspects of the present disclosure provide for a variety of benefits. Conventional techniques of containing a soluble or sacrificial anode within a porous anode bag are utilized to prevent large-sized contaminants from entering the electrolytic solution; however, smaller sized particulates may still move through the porous anode bag and enter the solution, which can cause a non-uniform deposition of the metal layer over the workpiece. It can be appreciated that the use of repeated or continuous dummying operations, as well as locating the first anode and second cathode in separate tanks or reservoirs, can greatly reduce the chance of particulate matter being liberated within the fluid reservoir and reaching the workpiece cathode in a separate electroforming reservoir and therefore reduce any undesired irregularities in the electroformed component.

It can also be appreciated that the use of unequal or varied flow rates to the multiple anode chambers, as well as the use of conformable non-sacrificial anodes with unequal or varied spacing from the workpiece, can provide for improved customization of metal layer thicknesses in the finished electroformed component. Another advantage is that the additional anodic material in the anode chamber provides for a greater concentration of electrolytes in the enriched electrolyte solution, which reduces the time needed to electroform the finished component to a desired thickness. In addition, the apertures in the electroforming reservoir can be utilized to provide a variety of "throw angles" or impingement angles of the enriched electrolyte solution on the workpiece. Such tailoring of throw angles can improves the coverage of electrolyte solution over hard to reach areas of the workpiece, as well as provide for custom metal layer thickness at various regions of the electroformed component.

Still another advantage is that the electroforming reservoir can be configured to accommodate a wide variety of shapes and sizes for different workpieces. For example, the multiple-piece electroforming reservoir can be injection molded with any desired shape to accommodate brackets, duct sections, hardware, or manifolds, in non-limiting examples. In addition, another advantage is that multiple electroforming reservoirs can be fluidly coupled to a common fluid dissolution reservoir such that multiple components can be simultaneously electroformed in their respective electroforming chambers. This can increase production speed and improve process efficiencies during formation of the electroformed components. Separation of the electroformed component and the fluid reservoir can also provide for a less populated working area; e.g. small workpieces can be positioned in small reservoirs, and large workpieces within large reservoirs, instead of a small workpiece placed within a large electroforming bath tank. Still another advantage can be realized in that adjustment of components within the fluid reservoir can be more easily accomplished without disturbing the electroforming reservoirs or cathodes therein.

Aspects of the present disclosure can provide for mass production of electroformed components. Traditional electroforming processes are typically utilized for small-batch operations, as time is spent individually electroforming components and cleaning or purifying electrolytic solution between electroforming processes. In one example, the system and method described herein provides for generating electroformed components at a rate between 30 and 50 times larger than traditional electroforming processes can produce, which enables mass production of electroformed components instead of being limited to small-scale production runs.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electroforming reservoir, comprising:

a housing having a first fluid inlet, a second fluid inlet, and a drain outlet, the housing comprising:

an electroforming chamber at least partially defined by a first sidewall and a second sidewall, with the drain outlet provided at the electroforming chamber;

a first anode chamber separated from the electroforming chamber by the first sidewall, with the first fluid inlet provided at the first anode chamber;

a second anode chamber separated from the electroforming chamber by the second sidewall, with the second fluid inlet provided at the second anode chamber;

a first anode defining the first sidewall and having an aperture in the first sidewall fluidly coupling the first anode chamber to the electroforming chamber;

a second anode defining the second sidewall and having an aperture in the second sidewall fluidly coupling the second anode chamber to the electroforming chamber;

a third anode within the first anode chamber; and a fourth anode within the second anode chamber.

2. The electroforming reservoir of claim 1 wherein the electroforming chamber is configured to receive a workpiece defining a cathode.

3. The electroforming reservoir of claim 2 wherein the housing further comprises an opening such that a portion of the workpiece extends outside of the electroforming chamber.

4. The electroforming reservoir of claim 2, further comprising at least one conformable non-sacrificial anode located within the electroforming chamber.

5. The electroforming reservoir of claim 4 wherein the at least one conformable non-sacrificial anode comprises a plurality of anode strips conforming to a profile of at least a portion of the workpiece.

6. The electroforming reservoir of claim 1, further comprising drain openings in a base of the electroforming reservoir.

7. The electroforming reservoir of claim 1 wherein the electroforming chamber is positioned between the first and second anode chambers.

8. The electroforming reservoir of claim 7 wherein a flow rate of electrolytic fluid into the first anode chamber is less than a flow rate of electrolytic fluid into the second anode chamber.

9. The electroforming reservoir of claim 1 wherein at least one of the first third anode or the second fourth anode comprises a sacrificial anode.

10. A system for electroforming a component, comprising:

a fluid reservoir containing an electrolytic fluid, a reservoir anode, and a reservoir cathode;

a first power source electrically coupled to the reservoir anode and reservoir cathode;

at least one electroforming reservoir, comprising:

a housing, comprising:

an electroforming chamber defining a centralized chamber at least partially defined by a first sidewall and a second sidewall, the electroforming chamber having a drain outlet;

a first anode chamber separated from the electroforming chamber by the first sidewall and having a first fluid inlet;

a second anode chamber separated from the electroforming chamber by the second sidewall and having a second fluid inlet;

a first aperture in the first sidewall fluidly coupling the first anode chamber to the electroforming chamber;

a second aperture in the second sidewall fluidly coupling the second anode chamber to the electroforming chamber;

a first non-sacrificial anode located within the electroforming chamber and operably coupled to the first sidewall, the first non-sacrificial anode having an aperture therethrough aligned with the first aperture in the first sidewall;

a second non-sacrificial anode located within the electroforming chamber and operably coupled to the second sidewall, the second non-sacrificial anode having an aperture therethrough aligned with the second aperture in the second sidewall:

a third anode within the first anode chamber; and a fourth anode within the second anode chamber; and a fluid recirculation circuit passing from the fluid reservoir into at least one of the first fluid inlet or the second fluid inlet, into the electroforming chamber, through the drain outlet, and back to the fluid reservoir.

11. The system of claim 10 wherein the electroforming chamber is configured to accommodate a workpiece defining a second cathode.

12. The system of claim 11 wherein the second cathode and at least one of the first anode or the second anode are electrically coupled to a second power source, separate from the first power source.

13. The system of claim 11, further comprising at least one conformable non-sacrificial anode located within the electroforming chamber on the first sidewall and wherein the first anode and the at least one conformable non-sacrificial anodes have a nonuniform spacing distance from the workpiece.

14. The system of claim 10, further comprising a pump fluidly coupled to the fluid recirculation circuit.

15. The system of claim 10 wherein at least one of the third anode or the fourth anode comprises a sacrificial anode.

16. The system of claim 15 wherein the first anode chamber is fluidly coupled to the fluid reservoir via a first fluid conduit and the second anode chamber is fluidly coupled to the fluid reservoir via a second fluid conduit.

17. A method of electroforming a component in the system of claim 10, the method comprising:

introducing the electrolytic fluid to at least one of the first anode chamber or the second anode chamber within the at least one electroforming reservoir;

generating additional electrolytes in the electrolytic fluid by supplying electrical power to at least one of the third anode or the fourth anode to define an enriched electrolyte solution;

providing the enriched electrolyte solution into the electroforming chamber holding a workpiece; and depositing, via the enriched electrolyte solution, a metal layer onto the workpiece to define an electroformed component.

18. The method of claim 17 wherein a recirculation circuit fluidly couples the fluid reservoir and the electroforming chamber, and wherein the introducing and the providing includes continuously circulating the electrolytic fluid and the enriched electrolyte solution through the recirculation circuit.

19. The method of claim 18, further comprising performing a dummying operation in the fluid reservoir during at least one of the introducing, the generating, the providing, or the depositing.

20. The method of claim 18 wherein the first anode chamber is fluidly coupled to the fluid reservoir via a first fluid conduit and the second anode chamber is fluidly coupled to the fluid reservoir via a second fluid conduit.

21. The method of claim 20 wherein a flow rate of the electrolytic fluid into the first anode chamber is less than a flow rate of the electrolytic fluid into the second anode chamber.

22. The method of claim 17, further comprising locating a set of conformable anodes about the workpiece.

* * * * *